United States Patent [19]

van den Berg

[11] Patent Number: 4,530,236

[45] Date of Patent: Jul. 23, 1985

[54] SOIL INVESTIGATION DEVICE

[75] Inventor: Arie P. van den Berg, Heerenveen, Netherlands

[73] Assignee: Ingenieursbureau A. P. Van den Berg B.V., Heerenveen, Netherlands

[21] Appl. No.: 452,789

[22] Filed: Dec. 23, 1982

[30] Foreign Application Priority Data

Dec. 24, 1981 [NL] Netherlands ..... 8105858

[51] Int. Cl.³ ..... G01N 3/00

[52] U.S. Cl. ..... 73/84; 73/864.45; 175/162; 175/203

[58] Field of Search ..... 73/84, 864.45; 200/61.52; 175/162, 203

[56] References Cited

U.S. PATENT DOCUMENTS

| | | | |
|---|---|---|---|
| 2,820,116 | 1/1958 | Alberts | 200/61.52 |
| 3,054,285 | 9/1962 | Roosen | 73/84 |
| 3,331,240 | 7/1967 | Nilsson et al. | 73/84 |
| 3,999,424 | 12/1976 | Pellissier | 73/84 |
| 4,398,414 | 8/1983 | MacGregor | 73/84 |
| 4,400,970 | 8/1983 | Ali | 73/84 |

FOREIGN PATENT DOCUMENTS

| | | | |
|---|---|---|---|
| 769863 | 3/1957 | United Kingdom | 73/864.44 |

*Primary Examiner*—S. Clement Swisher

*Attorney, Agent, or Firm*—Beehler, Pavitt, Siegemund, Jagger & Martella

[57] ABSTRACT

A device for performing soil inspection by means of a tube to be driven into the soil, comprising driving means which grip around the tube substantially coaxially said driving means comprising either a cylinder with a hollow piston rod or pairs of opposed driving wheels. Auxiliary means are provided for facilitating soil inspection operations with such a device, such as an improved pressing and pulling head, and means for signal transfer from a measuring cone towards measuring instruments at the soil surface.

13 Claims, 10 Drawing Figures

SOIL INVESTIGATION DEVICE

Figure 1:
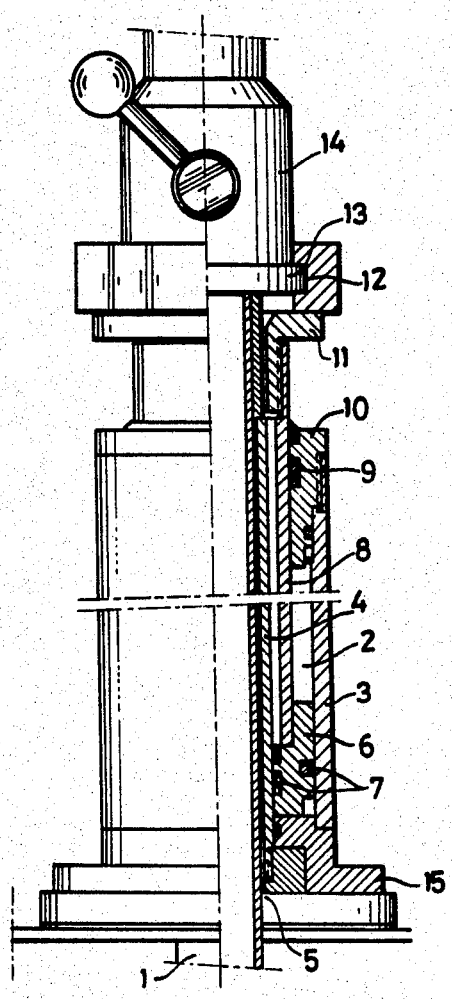

For executing soil investigation, a tube is driven substantially vertically into the soil, which tube, at or near its lower extremity, is constructed either as a sounding tube, in which case it is provided with means for determining the resistance against displacement, e.g. in the form of a so-called sounding cone and/or sounding sleeve, or as a sampling tool by means of which a sample of the soil can be takne in order to be investigated in a laboratory.

In order to press such a tube into the soil, use is made of a device, which is generally arranged in a vehicle, comprising a yoke which is to be brought into engagement with the upper extremity of the tube, which yoke is coupled with the pistons of the two pressure medium cylinders which are arranged at both sides of the tube. As soon as the tube has been pressed downwards by means of said yoke over the piston stroke, the yoke is moved upwards again, and another tube is connected to the former tube by means of a screw-thread connection, and then the tube is pressed further downwards. The force required therefor can be derived from the pressure of the pressure medium (generally oil). In the case of a sounding tube this force is generally determined by means of a transducer provided between the sounding tube and the yoke, and, on the other hand, force sensors are often arranged in the lower end part, which are adopted to produce an electrical signal which is a measure for the resistance met with, and which can be processed further at the surface.

As soon as the tube has reached the desired or maximum possible depth, a pulling head is mounted on the yoke, which is adapted to engage the tube in such a manner that, by means of said yoke, a pulling force can be exerted on the tube. Such a pulling head can, for instance, comprise a conical inner wall and a plurality of balls arranged in several layers within a cage, the diameter of said balls in the different layers being such that, if a tube is inserted through said cage with balls, the conical wall surface uniformly presses said balls against the tube surface, so that the pulling force will be transferred onto the tube.

An objection of such devices is that they are rather bulky and heavy, and must, therefore, be arranged in or on a vehicle. For measurements in difficultly accessible locations, in particular in existing buildings, e.g. for determining the bearing capacity of the foundation in view of reconstruction works, or in difficultly accessible fields, these known devices are not suitable.

It is an object of the invention to provide a device for the latter purposes which does not show these objections and is, in particular but not exclusively, suitable for being constructed in a transportable and, if required, portable manner.

To that end, the device according to the invention is characterised in that the driving means for the tube grip around said tube substantially coaxially.

In a first embodiment, said driving means comprise a single cylinder having a piston and associated piston rod which are made hollow, and this in such a manner that the tube can be led through the interior thereof, said piston rod being connected to a head by means of which the pressing and pulling forces can be transferred on the tube. This unitary construction without a yoke provides a substantial simplification in respect of the known constructions with two cylinders, and, furthermore, leads to substantially smaller dimensions, and, moreover, a pressure acting on the tube in an accurately axial direction is ensured.

In a second embodiment of the invention, the driving means comprise at least one unit consisting of a pair of mutually oppositely arranged driving wheels with a concave rim profile adapted to the shape of the tube to be driven, at least one of said wheels of such a unit being connected to a driving motor, in particular a hydraulic motor, and, in particular, several units can be superposed along the tube, means being provided in each unit for driving the wheels towards one another so as to increase the clamping force.

With such a device the tube can be driven continuously itself, but it is also possible to drive thereby an auxiliary tube which is provided with means adapted to be brought into engagement with the tube to be driven into the soil, and corresponding to the means used in the first embodiment.

If the driving means operate in a discontinuous manner and are to be reset when providing or taking away an extension tube section, preferably a special coupling element is used which is arranged in a horizontal sliding guide connected to the driving means, so as to allow this element to be slid away laterally for clearing the passage for a tube, and this element can be constructed as a pressing or pulling head respectively, said guide being adapted to allow the replacement of a pressing head by a pulling head and vice versa.

For application in the case of a sounding tube with an inner rod which is connected to a measuring element, the pressure head can be provided with a rotatable fitting with two bores of a different diameter, the narrower one forming an abutment shoulder for the upper extremity of the upper tube section but allowing the inner rod to pass so as to bring said inner rod into engagement with a superposed force meter, whereas the wider bore also passes the sounding tube so that the latter itself will, then, engage said force meter. In the latter case, for instance, the lateral friction in the soil along the sounding tube can be measured.

For retracting the tube, preferably a special pulling head is used comprising a sleeve surrounding the tube in which a plurality of slightly upwardly inclined strips of metal or the like are arranged having, at their free extremity, a concave rounding adapted to the tube periphery. By means of such a head the friction force required for the pulling force can be distributed more evenly over the tube surface, so that the latter will not be damaged, this in contrast to the above-mentioned pulling heads with balls which, in a rather small number, are being brought into engagement with the tube wall.

When using a sounding tube with an inner rod, the extension tube sections are preferably provided with inner rods which are secured against falling out, this in contrast to the known constructions.

If electrical force transducers or the like are provided in the lower portion of the sounding tube, a pressing or pulling head is to be used which is provided with recesses for passing a measuring cord. Furthermore it can be advisable to arrange the current source for the measuring circuit in the lower part, and then, in particular, the inner rods of the sounding tubes sections can be used as a conductor for signal circuits, said inner rods being provided with coupling means adapted to interconnect adjacent rods electrically; the contact resistance between the various inner rod sections will, then, have no influence on the signal available at the transducers. The time-consuming and troublesome stringing of the sounding tubes on an electric cable is, then, superfluous.

Instead of electrical signal transfer, also modulated radiation can be used, and then, in the lower portion of the sounding tube, a radiation source, in particular a laser diode, and in the upper end portion of this tube a photo-diode or the like will be arranged. The inner tube diameter is, preferably, chosen as large as is compatible with the strength of the tube so as to keep free a direct radiation path even in the case of bending of the tube. It is also possible to polish the inner wall so as to allow, if necessary, radiation transmission by reflection, but then care should be taken to avoid disturbing signal broadening by transit time differences, e.g. by a suitable choise of the modulation shape or by screening off undesired radiation directions near the photodiode.

It can sometimes be favourable to include in the lower portion of the sounding tube a memory in which the measurement results can be stored, which can be read out later after retraction of the sounding tubes, and a timing signal should, then, be recorded, allowing to correlate the measurements with the insertion depths recorded at the surface. As a memory, besides a usual electronic memory, also a small tape recorder with micro-cassettes can be used.

Such a tube can also be constructed as a soil sample cutter, an improvement being obtained by accommodating the usual hose, used for reducing the friction between the soil sample and the tube wall, in a chamber surrounding the sample space of the tube, said chamber being situated between the cutting mouth at the lower extremity of the tube and the exit slot between said chamber and the sample space, so that the hose provided in this chamber can be pulled straightly upwards through the slot, intrusion of soil particles into said chamber being hampered, and damaging the hose in the slot being avoided then, so that the use of a supporting liquid, as is required in the current soil sample cutters in which the hose is deflected by 180° in the slot, will be superfluous.

Such a device for driving a tube into the soil should be directed vertically as well as possible. To that end, as usual, hydraulically actuated jacks can be used by means of which the carrier of the device, in particular a vehicle, can be supported. According to the invention, preferably an inclination sensor is used then, consisting of a housing filled with oil in which an electrically conductive body is resiliently supported, which body will contact electrical contacts provided around the circumference as soon as the housing is not directed exactly vertically, which body and contacts are included in a control circuit for the pressure medium supply. Inclination meters to be provided in sounding tubes adapted to measure the inclination of the tube, so as to correlate the inclination with the depth measurement, are known per se. For directing a device of the present kind, however, inclination meters have not yet been used. The sensor according to the invention allows to direct the device in a fast and precise manner.

Figure 2A:
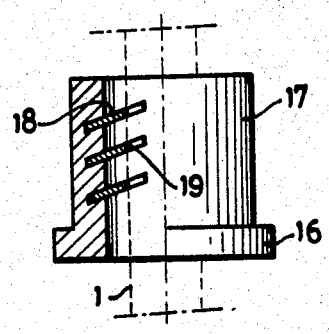
Figure 2B:
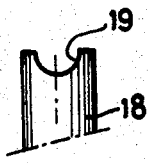
Figure 3:
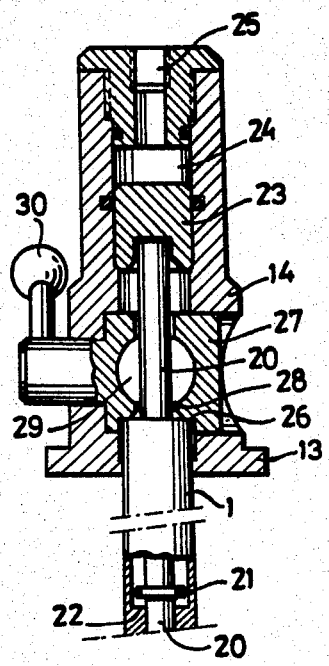
Figure 4:
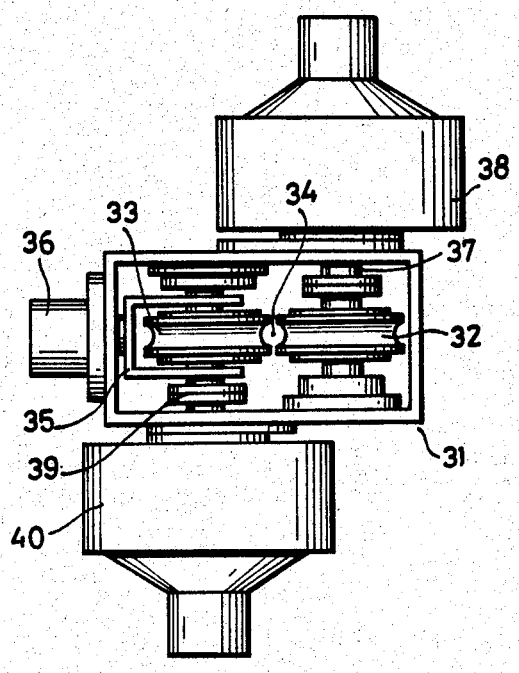
Figure 6:
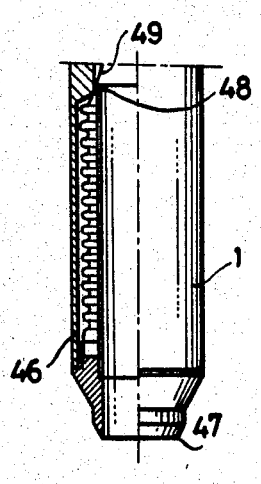
Figure 7:
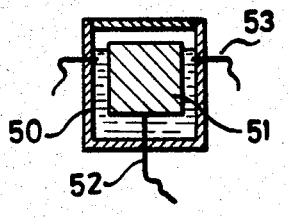
Figure 5A:
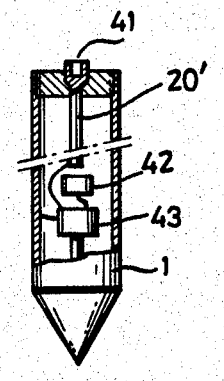
Figure 5B:
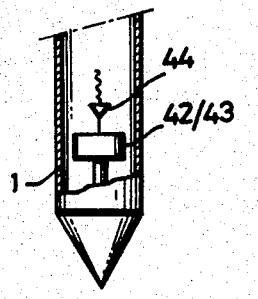
Figure 5C:
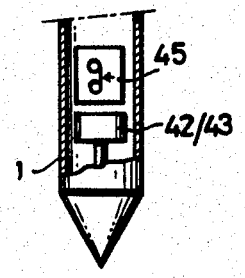

The invention will be elucidated in more detail below by reference to a drawing, showing in:

FIG. 1 a lateral view, partly in section, of a first embodiment of the invention;

FIGS. 2A and 2B a lateral view, partly in section, of a special pulling head for such a device, and a top view of an element of this pulling head resp.;

FIG. 3 a section of a special pressing head with a measuring body for such a device;

FIG. 4 a diagrammatic top view of an other embodiment of a device according to the invention;

FIGS. 5A, 5B and 5C highly simplified representations of different means for transmitting signals in such a device;

FIG. 6 a simplified representation, partly in section, of a cutting tube to be used in such a device; and FIG. 7 a diagrammatic cross-section of a simple inclination sensor for such a device.

In FIG. 1 a first embodiment of the device according to the invention is diagrammatically shown, which device is intended for pressing a tube 1 into the soil and, respectively, pulling it therefrom again, which tube is, in particular, a sounding tube.

This device comprises an annular cylinder space 2 defined between an outer wall 3 and a coaxial inner wall 4, the inner wall 4 defining a space 5 in which the tube 1 fits with some play.

In the cylinder space 2 an annular piston 6 sealingly contracting the walls 3 and 4 by means of sealing rings 7 is slidable. This piston 6 is connected to a tubular piston rod 8 guided by means of seals 9 in a cap 10 closing the space 2. At the upper end of the piston rod 8 a flange 11 is mounted on which a horizontal sliding guide 12 is provided in which a rim 13 of a pressing head 14 to be described below is horizontally slidable, so that, when sliding away this head, the inner space 5 of the inner wall 4 becomes accessible from above so as to insert a tube 1 into it, which tube can be an extension tube which can be screwed on another tube section 1 already pressed downwards.

The piston 6 is shown in its lowest position, and can be moved upwards by supplying a pressure medium, e.g. oil, the stroke length corresponding to the length of the tube sections from which the tube 1 is to be assembled. After having said away the head 14 in the highest position, another tube section can be introduced into the space 5 and screwed on the preceding tube section, after which the head 14 can be slid back so that it can be brought into engagement with the upper extremity of the tube. Thereafter the pressure medium will be supplied to the upper side of the piston 6 so as to press the tube 1 further into the soil.

The cylinder wall 3 is mounted in a foot 15 which is immobilised in respect of the soil in a manner not shown. This foot is, for instance, mounted on a sufficiently heavy vehicle, but can also be fixed by means of ground anchors or the like. The latter will be the case if the device is constructed as a portable one which is adapted for being used in inaccessible places (e.g. in a basement or the like).

Such a device requires little space, since only one cylinder without a bridge piece is used. Only the guide 12 is laterally protruding, but can be relatively short. The pressure medium source can be mounted separately from the device, and can be coupled thereto by means of pressure hoses.

In order to retract a tube 1 pressed into the soil, the rim 16 of a pulling head 17 according to FIG. 2 can be slid into the guide 12. Instead of the usual pulling heads with balls bearing on a wedge-shaped surface and adapted to contact the outer side of the tube 1, which may locally indent the tubes, use has now been made of a plurality of lips 13 made of hard steel or the like which are fixed at a slight upward inclination in the wall of the head 17, and are provided, at their free extremity, with a recess with a rounded boundary edge having a curvature which corresponds to that of the external surface of a tube 1. The number of lips 18 depends on the width thereof, the depth of the recess, and the required force.

As soon as a tube 1 arrives into the space between the lips 18 from below, the rims of the recesses 19 come into contact with the tube wall. When retracting the head 16, the tube 1 is gripped firmly between the lips 18. Since the clamping force has, now, been distributed over a much larger surface portion of the tube wall than in the case of clamping balls, the tube wall will not be damaged. On pressing downwards the head 17, the lips 18 will be released automatically, and the head can be removed from the tube.

In FIG. 3 a cross-section of a special embodiment of the pressure head 14 is shown, which serves, at the same time, as a force meter. In this case the tube 1 comprises an inner rod 20 which is guided slidably in the tube 1, and is, at the lower end, connected to a measuring cone or the like for determining the soil resistance. Each extension tube section is provided with such a rod 20, and the end faces of adjacent rods 20 can contact each other. In order to avoid that the rods 20 fall out of the corresponding tube sections, each rod is provided with one or more rings 21 which can abut against a corresponding shoulder 22 in the tube section 1 in question so as to prevent falling out.

In the head 14 a piston 23 is situated, against which the rod 20 of the uppermost tube section will bear when the head is pressed on the tube section. The space 24 above the piston 23 communicates, by means of a fitting 25, with a pressure meter or force transducer, not shown, for measuring the force acting on the rod 20.

The end face of the tube 1 bears on a shoulder 26 which is in a fixed position in respect of the head. This shoulder forms a part of a rotatable insert 27, and is defined by a through bore 28 in said insert through which the rod 20 extends upwards. Transversely to the bore 28 a second wider bore 29 is formed in the insert. If the insert 27 is turned 90° by means of a handle 30, the wider bore 29 is positioned in alignment with the tube 1. This bore is wider than the tube 1 so that, then, the end face of the tube 1 will bear against the piston 23. This position will be used if, for instance, the adhesion force exerted on the tube 1 by the soil is to be measured.

FIG. 4 shows an other embodiment of the device of the invention for pressing a tube into the soil. This device comprises at least one unit 31, but, if required, a plurality thereof can be superposed. Each unit comprises a pair of wheels 32 and 33 with an outer rim of substantially semicircular cross-section, which wheels thus define a substantially circular cavity 34 in which a tube to be driven will fit. The wheel rims can be roughened or can be provided with a friction covering in order to increase the grip on such a tube. The wheel 33 is contained in a yoke 35 coupled to a pressure medium cylinder 36 by means of which this yoke can be pressed against the other wheel 32 so as to improve the grip on the interposed tube still more.

The shaft 37 of the wheel 32 is coupled to a hydraulic motor 38 adapted to drive the wheel 38. If a larger driving force is desired, also the shaft 39 of the wheel 33 can be coupled to a motor 40. The driving force can be increased still further by increasing the number of units 31.

Such a unit can, for instance, be used to drive a tube 1 directly so as to obtain a substantially continuous drive. Coupling extension tube sections can take place during driving. It is, however, also possible to use such a unit for driving a tube corresponding to the piston rod 6 of FIG. 1, adapted to connect thereto a pressing head 14 and/or a pulling head 17.

Instead of a pressure head 14 with a force meter according to FIG. 3, other force measuring apparatuses can be used, in particular measuring cones or the like with electrical force transducers. In that case a simple pressing head without measuring bodies can be used, but, then, said head should be provided with a recess for passing the measuring cord. For the measuring cord is to be stringed through all the tube sections to be used since the use of extension cords with contact plugs and sockets would lead to too high contact resistances. Of course pressing heads constructed in a different manner can be used instead which, if desired, can be constructed as a pulling head too. Such measuring cords are, by their nature, troublesome. The invention provides a number of possibilities allowing to work without such measuring cords.

As shown in FIG. 5A, a central rod 20 can be used instead of a measuring cord, which rod needs not to be slidable, and can be provided, at an extremity, with a fitting 41 in which the extremity of the rod 20′ of an adjoining tube section will fit more or less tightly so as to obtain an electrical connection, and the tube sections 1 themselves serve as a return conductor. It can, then, be advisable to arrange the current source 22 for the measuring circuit near the transducer 43 in the lower part of the tube 1, so as to ensure a sufficient voltage near the transducer 43 independent of the contact resistance in the couplings between the rods 20′. The transducer 43 can be provided with a circuit which is adapted to transform the measurement results into suitable measurement signals, e.g. in digital form.

Instead thereof it is also possible to use, for the signal transfer, modulated radiation, and then, as shown in FIG. 5B, the transducer 43 can be connected to a radiation source 44, e.g. a laser diode, which can send directed radiation through the interior of the tube, and at the upper extremity of the tube 1 a radiation receiver, e.g. a photo-diode, will be arranged. The tube 1 is, preferably, made as wide as is compatible with the strength of the tube, so as to maintain an unimpeded passage for the radiation even in the case of bending of the tube. It is also possible to polish the inner wall of the tube 1 in such a manner that the radiation will be transferred by successive reflections, and, then, care should be taken that only radiation with a given path length can reach the receiver, and radiation with a different path length is screened there so as to avoid unsharpness in the signal transmission caused by path length differences.

FIG. 5C shows still another solution in which the transducer 43 is coupled to a memory 45 in which the measurement results can be stored. After the tube is retracted again, the measurement results can be read out from said memory. Timing signals should be recorded then at the same time so as to allow to relate the measurements to the insertion depth which is continuously recorded above ground, this also with the associated timing signals. Such a memory can, for instance, be formed by a small tape recorder with microcassettes.

Such a tube 1 can also be constructed as a sample cutter for taking soil samples. It is usual to counteract disturbation of the soil samples by wall friction by enclosing the sample by a hose. This hose is provided, in the known samplers, in an annular chamber surrounding the tube cavity into which the sample is inserted, and then the hose can enter the central bore at the lower end of this chamber through an annular slot, and the hose is closed there so that a penetrating sample pulls the hose along. Bending the hose around the edge of this slot, however, can lead to damage, and also soil particles can penetrate into this chamber. Therefore sometimes a so-called supporting liquid will be used which is supplied to the hose chamber and facilitates pulling the hose through the slot and, moreover, keeps soil particles out of this chamber. Furthermore this liquid acts as a lubricant for the hose.

According to the invention such a cutting tube can be made in a simple manner as shown in FIG. 6, in which the hose chamber 46 is situated between the cutting mouth 47 at the extremity of the tube 1 and an exit slot 48 for the hose 49, so that the hose can be pulled substantially linearly from the chamber 46. Damaging the hose in the slot 48 is prevented then, and, moreover, penetration of soil particles is prevented. A supporting liquid can, then, be omitted, which considerably simplifies the construction of the over-all device.

In order to drive the tube 1 correctly vertically into the soil, the device should be directed vertically as well as possible. In the case of a device mounted on a vehicle, generally jack cylinders will be used having piston rods provided with foot plates which can be driven outwards by a pressure medium such as oil for relieving the springs of the vehicle, and, by a separate pressure medium supply towards the different cylinders, the floor of the vehicle can be horizontally adjusted.

The invention provides means for considerably accelerating these operations and making them independent of human intervention and, thus, of errors. To that end a special sensor shown in FIG. 7 is preferably used. This sensor comprises a substantially cylindrical housing 50 filled with oil, in which a float 51 of insulating material is provided which, by means of a spring 52, is kept in the centre when the housing 50 is directed vertically. In the inner wall of the housing electrical contacts 53 are provided adapted to contact the float 51 as soon as the housing 50 has been removed somewhat from the vertical orientation. The spring 52 is, with these electrical contacts, included in a control circuit by means of which, in correspondence with the orientation of the float, the pressure medium supply towards the different jacks can be regulated. A fast, automatic and accurate orientation of the device can be obtained thereby.

The device according to the invention can also be used for driving a drainage tape into the ground by means of a protecting tube which is finally retracted again, leaving a a wedge-shaped driving end piece to which the tape is attached in the soil.

The embodiments allowing a continuous driving force to be exerted are particularly suitable for sounding purposes, as an interrupted movement of a sounding tube may influence the measurement results.

In the embodiment of FIG. 4 the driving motors 38 and 40 can, of course also be electric motors.

Many other modifications are possible within the scope of the invention as defined in the appended claims.

I claim:

1. A device for driving a rod or tube into the soil comprising means for fixedly supporting the device with respect of the ground, means for driving a tube or rod or a string of interconnected tubes or rods substantially vertically into the soil and retracting it therefrom again, said driving means comprising a housing defining a cylinder, a hollow driving piston including a piston rod movable through a stroke within said cylinder, said piston and piston rod having a hollow bore axially therethrough such that the tubes or rods can be led through said bore, said piston rod being connected to a driving head by means of which a pressing force can be exerted on the upper end of the tube or rod being driven into the soil, said head being mounted to said housing by head coupling means including a horizontal sliding guide so as to allow said head to be shifted away laterally from the piston bore to thus expose the piston bore for insertion of a rod or tube thereinto, said head coupling means being adapted for interchangeably accepting either a pulling head or a pressing head.

2. The device of claim 1 adapted for driving a sounding tube into the soil, said tube having an inner rod connected to a measuring element wherein the pressing head is further provided with a rotatable fitting in which are defined two bores of a different diameter, the smaller one forming an abutment shoulder for the upper end of the tube but letting through the inner rod so as to allow the latter to contact an overlying force meter provided in the pressing head and the larger one letting through also the tube so that the latter itself is allowed to contact said force meter.

3. The device of claim 1 wherein said pulling head comprises a case surrounding the tube to be pulled and in which a plurality of somewhat upwardly inclined strips of steel or the like are mounted said strips having a free extremity provided with a recess adapted to engage the circumference of the tube so as to hold the tube against downward movement relative to said pulling head but allowing upward sliding movement therethrough.

4. The device of claim 1 adapted for driving a string consisting of a plurality of interconnected extension tubes each extension tube including an axially slidable central rod further comprising means for securing the central rods of each extension tube against falling out from said tubes.

5. The device of claim 1 in which the tube being driven is constructed as a sample cutting tube provided near its lower end with a chamber surrounding a sample cavity, said chamber accommodating a hose, which chamber communicates with the sample cavity by means of an exit slot, the sample cavity being situated between the lower end of the tube and the exit slot.

6. A device for driving a rod or tube into the soil comprising means for fixedly supporting the device in respect of the ground and means for driving a tube or rod or a string of interconnected tubes or rods substantially vertically into the soil and retracting it therefrom again, wherein the driving means comprise one or more drive units each drive unit having a pair of opposed driving wheels with a concave rim profile adapted to the cross-section of the tube to be driven, at least one of the wheels of each said unit being connected to a driving motor, and tensioning means for urging said wheels against a tube placed therebetween, the driving wheel of said pair being adapted to engage the smooth outer surface of a tube without slipping.

7. The device of claim 6 adapted to a sounding tube provided with electrical measuring elements, wherein said driving means comprise a drive unit to be brought into engagement with the tube, said drive unit allowing passage of cable means connected to said measuring elements.

8. The device of claim 6 further comprising a sounding tube provided with electric measuring elements, and a current source for the measuring elements arranged near the lower end of said tube.

9. The device of claim 8, in which the tube being driven consists of a plurality of interconnected tube sections and each tube section is provided with a central rod, the central rods being provided with coupling means adapted for making an electrical connection between the central rods of adjoining tube sections.

10. The device of claim 8 further comprising a memory element mounted near said measuring elements, means being provided for registering a timing signal, thereby to enable correlation of the electrical measurements stored in said memory to insertion depths recorded above ground.

11. The device of claim 7 further comprising a radiation source in particular a laser diode mounted near said measuring elements, and an element sensitive to the emitted radiation, in particular a photo-diode, arranged at the upper end of said sounding tube.

12. The device of claim 11, wherein the inner tube diameter is chosen as large as is compatible with the strength required of the tube.

13. The device of claim 11 wherein the inner wall of the tube is smoothly polished.

* * * * *